US005249809A

United States Patent [19]

Wolf

[11] Patent Number: 5,249,809

[45] Date of Patent: Oct. 5, 1993

[54] METHOD OF PLAYING A WAGERING GAME

[76] Inventor: Fred Wolf, 10418 Lubao Ave., Chatsworth, Calif. 91311

[21] Appl. No.: 21,469

[22] Filed: Feb. 23, 1993

Related U.S. Application Data

[63] Continuation-in-part of Ser. No. 988,724, Dec. 10, 1992, Pat. No. 5,226,661.

[51] Int. Cl.[5] ..... A63F 1/00

[52] U.S. Cl. ..... 273/274; 273/292

[58] Field of Search ..... 273/274, 292, 309, 85 CP

[56] References Cited

U.S. PATENT DOCUMENTS 5,100,137 3/1992 Fulton ..... 273/274

OTHER PUBLICATIONS

Scarne's Encyclopedia of Games by John Scarne, pp. 290-294, Harper & Row, Publishers, 1973.

*Primary Examiner*—Benjamin H. Layno

*Attorney, Agent, or Firm*—Timothy T. Tyson; Joseph A. Compton; Lawrence S. Cohen

[57] ABSTRACT

A method of playing a wagering game where players successively become the "player-bank," i.e., wager against each of the other game players, is disclosed. The method offers the player-bank a plurality of wagering options to enhance player interest and involvement. A first option concerns a first process which involves the player-bank with only those successive players whose combined wagers are less than or equal to the player-bank's wager, while a second option concerns a second process which continues to involve the player-bank with successive players as long as his wager plus his winnings is not exceeded by his losses. In determining winners, players add the numerical value of cards dealt to them to find the least significant digit of the sum. The player having a least significant digit closest to a predetermined numerical goal without exceeding it is deemed the winner. In one preferred embodiment, the second process is canceled and replaced by the first process if the player-bank's least significant digit in an initiated second process equals the numerical goal.

20 Claims, 3 Drawing Sheets

METHOD OF PLAYING A WAGERING GAME

CROSS-REFERENCES TO RELATED APPLICATIONS

This application is a continuation-in-part of Application Ser. No. 07/988,724 filed Dec. 10, 1992, now Pat. No. 5,226,661 the disclosure of which is hereby incorporated by reference and made a part hereof.

TECHNICAL FIELD

The present invention relates generally to games and more particularly to wagering games.

BACKGROUND ART

Games having players successively designated as the player-bank are often played in cardrooms. The player-bank is a player who wagers against each of the other players for a number of game rounds, e.g., one or two rounds, after which the designation of the player-bank passes to the succeeding player (other common cardroom terms for this player are bank, banker, dealer bank dealer banker, player bank and player banker). To facilitate play, the player-bank and the other players are generally arranged in successive order (e.g., clockwise in some cardrooms—counterclockwise in others) about a game table, with a house supervisor situated in view of the players. If the game is one played with cards, the house supervisor typically deals the cards to the players. In exchange for the cardroom supplying the playing facilities, it is customary for the house supervisor to collect a fee from each player which may be a flat amount for each game play or, possibly, an amount based on elapsed time of play. Additionally, the house supervisor typically explains and administers the rules of the game in play.

SUMMARY OF THE INVENTION

The present invention is directed to methods of playing wagering games. The methods of the invention are especially suited for games in which players are successively specified to be a "player-bank" which wagers against each of the other players for one or more game rounds.

Preferred method embodiments in accordance with the invention are characterized by steps which offer the player-bank a plurality of wagering options for selection therebetween, followed by steps which implement the selected option. All wagering options include a step of physically providing wagers and a step of physically transferring amounts won and lost between game players. In the preferred embodiments, game winners are determined by setting a numerical goal, dealing players a plurality of symbols each representing a numerical value, adding the numerical values to obtain the least significant digit of the sum and comparing the least significant digit to the goal. Between the player-bank and another player, the one whose least significant digit is closest to the goal without exceeding it, is deemed the winner. A player who ties the player-bank, i.e., having the same least significant digit, is not involved in that round of play.

First and second wagering options respectively involve execution of first and second wagering processes on a first game round. The first process is characterized by executing steps of matching different portions of the player-bank's wager against other players' wagers. The player-bank is involved in transferring wagers only with those successive players whose combined wagers are less than or equal to the player-bank's wager. In this first process, the player-bank's win or loss are each limited to the player-bank's wager.

The second process is characterized by executing steps of initiating a balance equal to the player-bank's initial wager and modifying this balance by adding the player-bank's wins and subtracting the player-bank's losses against successive players. The player-bank is involved in transferring wagers with successive players as long as the balance exceeds zero. In the second wagering process, the player-bank's win may be the accumulated sum of the wagers of all other players, while the player-bank's loss is limited to the player-bank's wager.

In a preferred method embodiment, the second wagering option includes, if the balance at the end of the second process in the first game round exceeds the player-bank's wager, the steps of executing the first process in a second game round. This embodiment may also include the step of requiring the player-bank's wager in the succeeding game round to at least equal the balance at the end of the first game round.

In a preferred method embodiment, third and fourth wagering options are offered the player-bank for selection thereof if the player-bank initially selected the first wagering option or if the player-bank initially selected the second wagering option and his balance at the conclusion thereof was less than his wager. The third option includes the steps of executing, on the succeeding game round, the steps of the first process. The fourth option includes the step of passing the specification of player-bank to a successive player.

In another preferred method embodiment, a fifth wagering option is offered the player-bank. This option is characterized by steps of initiating the second process, completing the second process if the player-bank's least significant digit therein is other than the numerical goal and canceling the second process and replacing it with the first process if the player-bank's least significant digit equals the numerical goal.

Another preferred embodiment in accordance with the invention is characterized by execution of the steps of the second process. Wagering options are not involved in this embodiment.

The novel features of the invention are set forth with particularity in the appended claims. The invention will be best understood from the following description when read in conjunction with the accompanying drawings.

MODES FOR CARRYING OUT THE INVENTION

Figure 1:
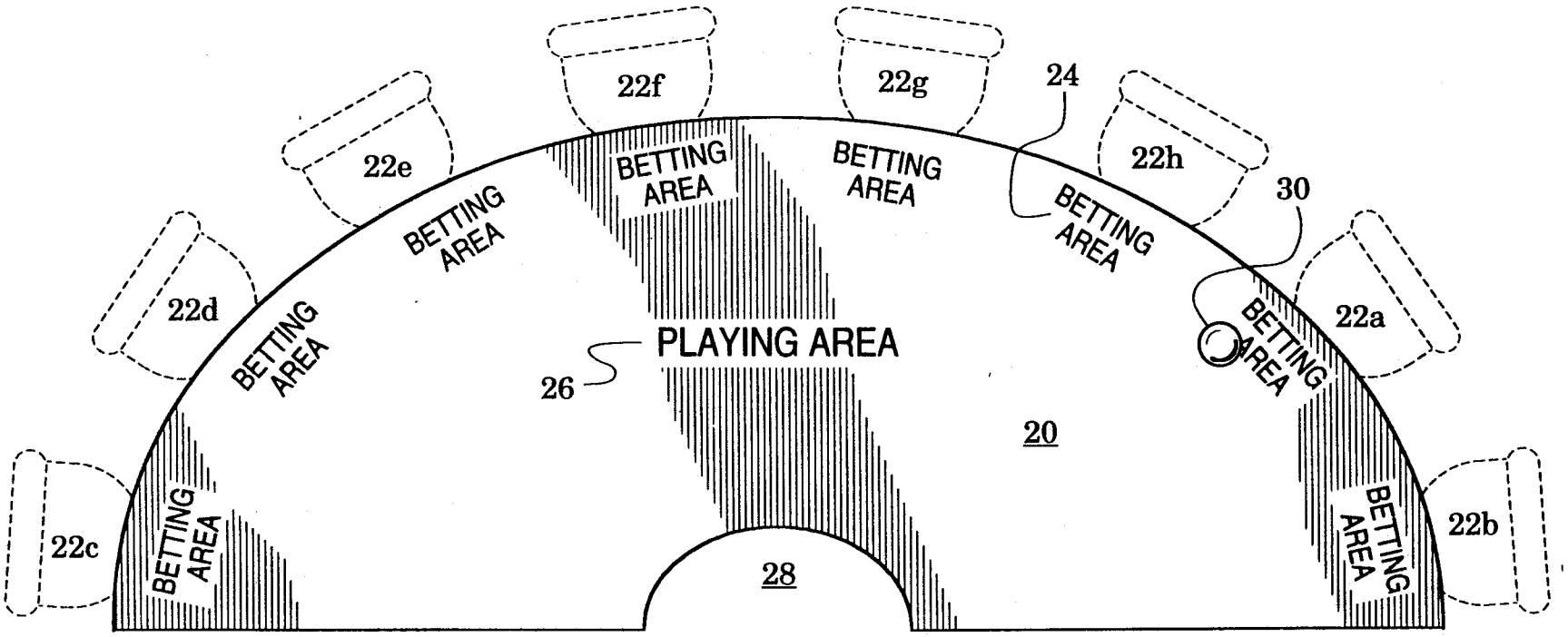
FIG. 1 is a plan view of a game table which may be used to practice a game playing method in accordance with the present invention.

Attention is first directed to FIG. 1 which is a plan view of a game table 20 suitable for practicing a preferred embodiment, in accordance with the present invention, of a method of playing a wagering game. The table 20 facilitates the arrangement of game players in successive order by seating them in chairs 22 about the table 20 where each chair is proximate to an associated betting area 24. The order of the positions is arbitrary, but is established in advance of the game. For example, the players may be successively ordered in a clockwise arrangement (i.e., a player in chair 22*a* precedes one in chair 22*b*, while one in chair 22*c* succeeds that in chair 22*b* and so on) or in a counterclockwise arrangement (i.e., a player in chair 22*c* precedes one in chair 22*b*, while one in chair 22*a* succeeds that in chair 22*b* and so on).

Arrangement of players in successive order facilitates progression in games where one of the players is designated the "player-bank". The player-bank is a player who wagers against each of the other players for a number of game rounds, e.g., one or two rounds, after which the designation of the player-bank passes to the succeeding player (for other common terms for the player-bank, see the background art section above). For example, if the player in chair 22*a* is the player-bank for a number of rounds set by the rules of the game in progress, then the player in chair 22*b* will be the next player-bank followed in succession by the player in chair 22*c* and so on. A game "round" refers to a game sequence which determines a winner between the player-bank and all other involved players, while a game "play" refers to a game sequence that determines a winner between the player-bank and one other player.

Games having players successively designated as the player-bank are often played in cardrooms where a house supervisor is situated in view of the players at location 28 defined by the game table 20. If the game is one played with cards, the house supervisor typically deals the cards to the players. He may place the player-bank's cards in a central playing area 26 while comparing them to each player's hand. In exchange for the cardroom supplying the playing facilities, it is customary for the house supervisor to collect a fee from each player which may be a flat amount for each game round or, possibly, an amount based on elapsed time of play. Additionally, the house supervisor typically explains and administers the rules of the game.

In accordance with the present invention, a method of playing a wagering game is provided which offers a plurality of wagering options to the game players. These options promote an increase in the number of players involved in each game round and the size of possible winnings. Consequently, the game becomes more exciting and enjoyable for the players and more profitable for the cardroom.

Figure 2B:
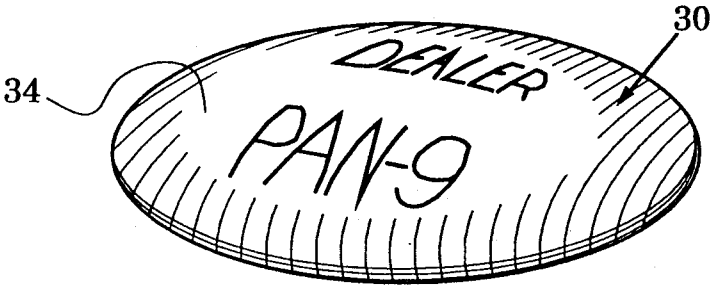
FIG. 2B illustrates a second face of the symbol of FIG. 2A.
Figure 2A:
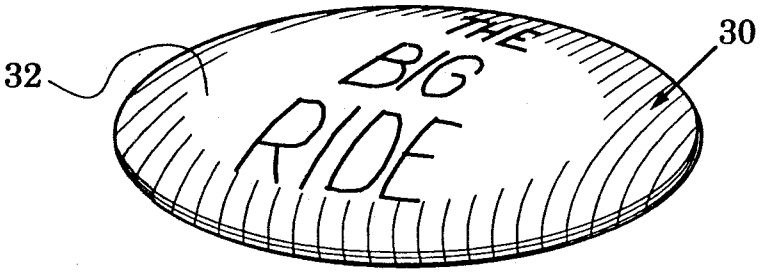
FIG. 2A illustrates a first face of a symbol which may be displayed in association with the present invention.

To identify the current player-bank and the wagering option chosen thereby, an emblem is placed proximate to the player-bank and oriented to indicate the chosen option to the other players. A preferred shape embodiment of this emblem is illustrated in FIGS. 2A, 2B to be a button shaped disk 30 with indicia on opposite sides. In this embodiment of the invention, the indicia "The Big Ride" is on one side 32 (FIG. 2A) and the indicia "Dealer Pan-9" is on the other side 34 (FIG. 2B). Although these specific indicia will be used in referring to game wagering options described below, it should be understood that any emblem indicia is generally consistent with the teachings of the invention as long as its association with the wagering options is established prior to playing the game.

As mentioned above, the player-bank is a player who wagers against each of the other players for the duration of one or more game rounds. Typically, a round is initiated by the player-bank and other players each physically providing a wager. Winners are then successively determined between the player-bank and each of the other players, after which amounts determined by the method are physically transferred from losers to winners.

Figure 3:
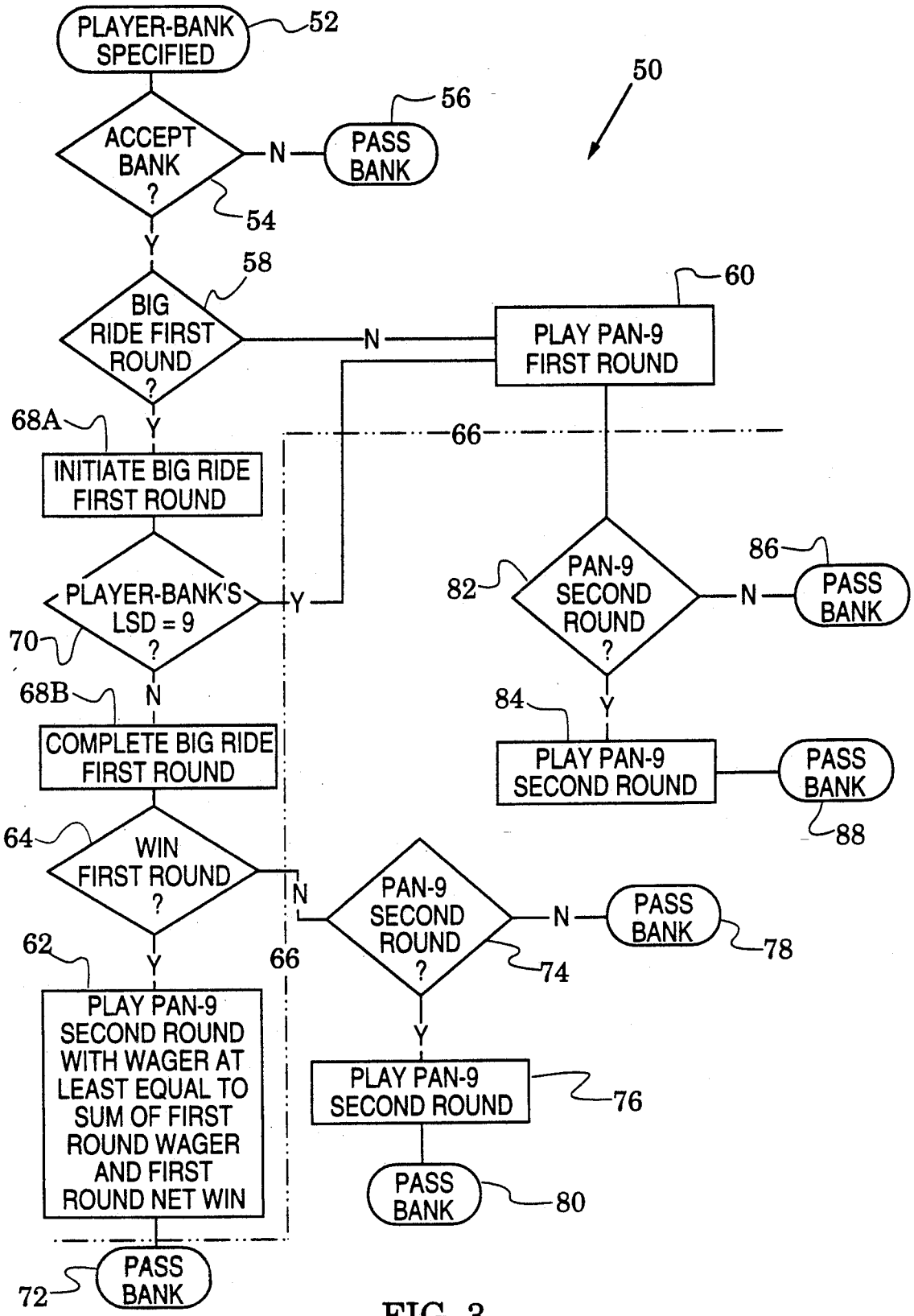
FIG. 3 is a flow chart illustrating a preferred embodiment of a game playing method.

Attention is now directed to FIG. 3, which is a flow chart 50 illustrating a preferred method embodiment. The method begins in terminator 52 with the specification of one player as the player-bank. Selection of the player-bank is typically specified by the rules of the game being played, e.g., the house supervisor may select a card at random and match its numerical value to a seat around the game table. Once the first player-bank is specified, the player-bank usually successively passes around the table, e.g., clockwise.

The specified player-bank first makes decision 54, which is to accept the player-bank specification or pass the specification of player-bank to the succeeding player as shown by terminator 56 (for clarity of illustration in FIG. 3, passing the specification of player-bank and accepting the specification of player-bank are respectively shortened to the phrases "pass bank" and "accept bank"). If the decision is to accept, the player-bank then must decide between first and second wagering options in decision 58, which asks if the player-bank wishes to play a "Big Ride first round." The decision at this point, once made, is especially important in that it may lead the player-bank all the way to one of two processes 60, 62. This is because the decision 64, leading to the process 62, is not under his direct control. The possible extent of the decision 58 is accordingly indicated by the broken line 66.

The preferred method description will first assume the player-bank chooses the first wagering option (rather than the second wagering option which relates to The Big Ride). He does this by declining to play a "Big Ride first round." Therefore, the method moves to process 60, which is to play a "Pan-9 first round."

The wagering process associated with this first option (which may hereinafter be referred to as a Pan-9 round) may be described with reference first to FIG. 1. Assume the player-bank is in chair 22*a*. In the preferred method, a second player known as "first action" is specified, e.g., by the player-bank rolling three dice and the house supervisor counting the seats clockwise, starting with the player-bank as number one, until the number displayed on the dice is attained. If the player successive order is clockwise and if first action has been specified to be the player in chair 22*d*, then successive players are those in chairs 22*e*, 22*f* and so on.

Figure 4:
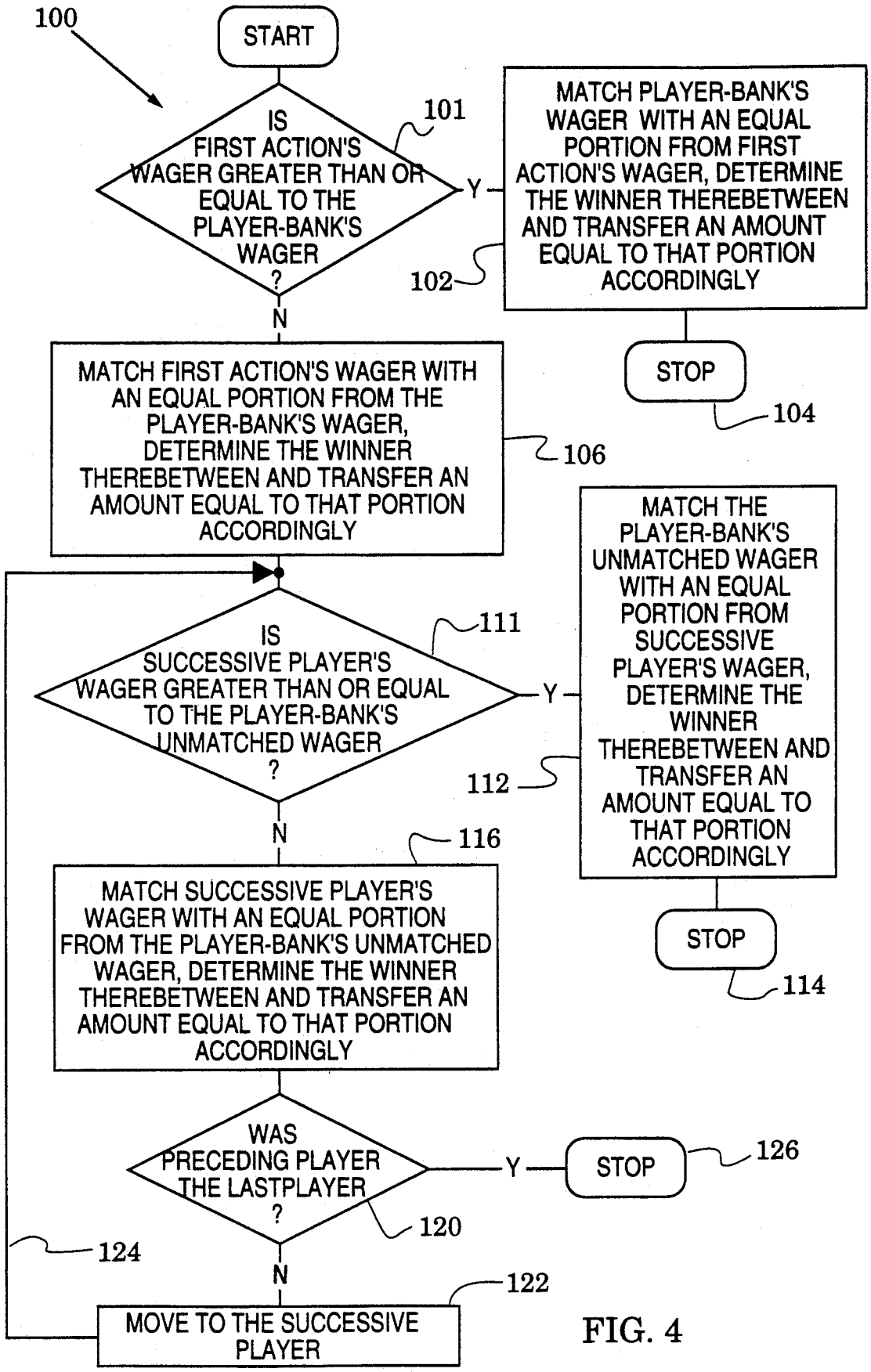
FIG. 4 is a flow chart illustrating a process of the flow chart of FIG. 3.

In a Pan-9 round, wagers are transferred as shown in the flow chart 100 of FIG. 4, which details wagering process steps of process 60 of FIG. 3. If first action's wager is greater than or equal to that of the player-bank, the method moves from decision 101 to process 102, where the player-bank's wager is "matched" (placed in opposition) with an equal portion of first action's wager. In process 102, an amount equal to this portion is transferred from the player-bank to first action if first action is the winner therebetween and from first action to the player-bank if the player-bank is the winner therebetween. The wagering process then ends with terminator 104.

If first action's wager is less than the player-bank's, the method moves to process 106, where first action's wager is matched with an equal portion from the player-bank's wager. In the manner described above, an amount equal to this portion is then transferred to the winner.

Decision 111, process 112, terminator 114 and process 116 repeat the above described steps of decision 101, process 102, terminator 104 and process 106 with first action replaced by the successive player, i.e., the next clockwise player from first action, and with the player-bank's wager replaced with the player-bank's unmatched wager. That is, after first action's wager was matched by an equal portion of the player-bank's wager in process 106, only the player-bank's unmatched portion (player-bank's wager less first actions's wager) is left for matching with the successive player.

Decision 111, process 112, terminator 114 and process 116 are continued with successive players as indicated by decision 120, process 122 and loop 124. It can be seen from these steps that if the player-bank's wager was greater than the combined wager of all other players, the steps end with terminator 126. In this case, loop 124 is followed for all successive players because the player-bank's wager was sufficient to match the combined wager of all other players. Therefore, all players are involved in transferring of wagers at the end of the game round.

If the player-bank's wager was less than or equal to the combined wager of fewer than all of the other players, the steps end in terminator 114 because the steps of the method end when all of the player-bank's wager has been exhausted in matching the wagers of successive players.

The flow chart of FIG. 4 assumes that a winner is determined in each case. If instead, a tie is determined between a player and the player-bank, no amount is transferred between that player and the player-bank and no portion of the player-bank's wager is matched. Essentially, a player who ties the player-bank is not involved in that game round and the method moves on to the successive player.

Attention is now directed to the determination of a winner between the player-bank and other players. In preferred embodiments of the method, a deck is used which consists of either eight or twelve standard playing card decks having the sevens, eights, nines and tens removed. The face cards (jack, queen and king) are assigned a value of zero, the ace is assigned a value of one and the remaining cards are assigned the number displayed on the card. After wagers have been placed, cards are dealt to each player, their numerical values are added and the least significant digit of the sum is compared to nine. The winner is the player whose least significant digit is closest to nine without exceeding it.

It should be understood that if the sum exceeds nine, the least significant digit of the sum may be obtained by subtracting ten or twenty therefrom as appropriate. For example, if the sum is twelve, one may subtract ten to obtain the least significant digit of two. If the sum is twenty three, one may subtract twenty to obtain the least significant digit of three.

Initially, three cards are dealt to each player. Starting with first action, each player chooses between the options of receiving a fourth card ("taking a hit") or staying with three cards ("standing pat"). In the case of the player-bank, this choice is exercised after all other players have exercised their options and after the player-bank's cards have been turned face up. Players other than the player-bank are free to exercise their option to a fourth card. The player-bank, however, must adhere to restraints in receiving a fourth card. If the least significant digit of the sum of the player-bank's first three cards is 4, 5 or 6, the player-bank may decide whether or not to receive a fourth card. If the least significant digit is smaller, the player-bank must receive the fourth card and, if it is higher, the player-bank may not receive the fourth card.

Comparison of the sum's least significant digit to the goal of nine is easily understood by reference to the following examples. If the player-bank ends up with two sixes and a four, his sum is 16 and the sum's least significant digit is six. If first action has a three, a king, an ace and a four, his sum is eight as is also his least significant digit. Since eight is closer to nine than is six, first action is the winner against the player-bank. In another example, if the player-bank initially has two sixes and a three and then decides to receive a fourth card which is another three, his sum is 18 and his least significant digit is eight. If first action initially has an ace, a three and a queen and also receives a fourth card which is a six, his sum is 10, his least significant digit is zero and he would lose to the player-bank.

The preferred method embodiment described above for determining a winner is similar to that used in a cardroom game typically called "Super Pan-9" whose game rules are well known, e.g., see Mason Malmuth, *Gambling Theory and Other Topics* (Las Vegas: Mason Malmuth, © 1990). Other embodiments for determining a winner may have different numerical goals, employ symbols other than playing cards and deal different numbers of symbols. Thus, the invention generally teaches determination of a winner by first setting a numerical goal. Secondly, a plurality of symbols having a numerical value are dealt to each player. The numerical values are added to determine the least significant digit of the sum and this least significant digit is compared to the goal. The player having a least significant digit closest to the goal without exceeding it is the winner. If the players have the same least significant digit, it is a tie. It should also be understood that the teachings of the invention extend to any means of dealing numerical values to players, e.g., displaying symbols on a television monitor.

From the above, it may be seen that in a Pan-9 player-bank wagering process, determination of winners and transfer of wagers (or portions thereof) between the player-bank and other players involves those successive players, starting with first action, whose combined wagers are less than or equal to the player-bank's wagers (ignoring players that tie the player-bank).

For example, if the player-bank's wager is $50 and all other players wager $20, $20 of the player-bank's wager will be matched against first action, $20 against the first successive player and $10 of the player-bank's wager will be matched against the second successive player. These matched portions will then be transferred between the player-bank and these three involved players in accordance with determination of the winner in each case. No other players will be involved in transfer of wagers in this game round.

The number of involved players in a specific game round, in addition to the player-bank, may therefore be as few as first action (i.e., one player) or as many as all other players. Since the process terminates when the player-bank's wager has been matched against other players' wagers, the player-bank may win or lose only as much as his wager.

Returning to flow chart 50, an affirmative answer at decision 58 indicates the player-bank has chosen a wagering process 68, which may hereinafter be referred to as playing a Big Ride round. In a first preferred embodiment involving the Big Ride wagering process, winners are generally determined between the player-bank and other players in a manner similar to that in the Pan-9 wagering process described above. In this embodiment, the decision 70 of FIG. 3 is ignored and processes 68A, 68B may be considered to be one process 68 of playing a Big Ride first round. A second preferred embodiment, involving the Big Ride wagering process, includes an added step relating to the separate processes 68A, 68B which will be described after the following first Big Ride process embodiment description.

In a Big Ride round, the player-bank's wins and losses are respectively added and subtracted from the player-bank's wager to calculate a balance. For example, if the player-bank is the winner against first action, the balance is the player-bank's wager plus the amount won from first action. If the player-bank loses to the player who succeeds first action, the balance is then reduced by that loss. As in the Pan-9 wagering process, if there is a tie between the player-bank and another player, that player is not involved in that game round and the method moves on to the successive player. No amount is transferred with that player and the player-bank's balance is unchanged.

In the Big Ride round, the amount to be transferred to the winner between the player-bank and first action is the lesser of the player-bank's wager and first action's wager or an amount equal to either of them if they are identical. The amount to be transferred to the winner between the player-bank and the player succeeding first action is the lesser of the balance (after transfer of the amount between the player-bank and first action) and that player's wager or an amount equal to either of them if they are identical. This process continues with each successive player until amounts have been transferred between the player-bank and all other players or until the balance falls to zero.

Therefore, in the Big Ride wagering process, the amount to be transferred to the winner between the player-bank and another player is the lesser of the amounts placed in opposition therebetween. The balance is placed in opposition by the player-bank, while a wager is placed in opposition by each of the other players. In the Big Ride process, the amount to be transferred may hereinafter be referred to as the bet. The player-bank's balance against first action is the same as the player-bank's wager since no amounts have yet been won or lost.

For example, if the player-bank's wager is $50 and all other players wager $40, the bet between the player-bank and first action is $40. If first action is the winner therebetween, $40 is transferred from the player-bank to first action, leaving a balance of $10. The bet between the player-bank and the first successive player (to first action) is $10. If that player is the winner against the player-bank, the bet is transferred from the player-bank to that player. This leaves a zero balance for the player-bank and the round ends. Alternatively, if the player-bank won against first action, the balance would be $90 and the bet between the player-bank and the player succeeding first action would be the lesser of the balance and the succeeding player's wager, i.e., $40.

If there were 8 players including the player-bank and, in the example above, the player-bank had won against each of the other players, the balance at the end of the round would be $330. That is, $40 would have been transferred to the player-bank from each of the other players and added to the player-bank's wager of $50. If instead, the player-bank won against the first three players and lost against the fourth, the balance would be $170 when the player-bank opposed the fourth player. The bet with the fourth player would then be the lesser of $170 and $40, which would be $40. After the loss to the fourth player, the balance would be $130.

Therefore, in the Big Ride process, the player-bank's wager plays against each successive player's wager unless the balance, increased and decreased respectively by player-bank wins and losses, is exhausted (the balance equals zero). In the Big Ride process, the player-bank's balance will accumulate with each successive player that the player-bank wins against. In the Pan-9 process, the player-bank's wager is matched with successive players' wagers and the player-bank's possible increase is limited to the player-bank's wager. In both processes, the player-bank's loss is limited to his initial wager.

As stated in the beginning of the Big Ride wagering process description, a second preferred embodiment includes an additional step to that described above in the first embodiment. This step involves the decision 70 of FIG. 3, which connects the two processes 68A, 68B. In process 68A the Big Ride is intiated. Decision 70 then asks if the least significant digit of the sum of the player-bank's final hand is nine in the Big Ride first round play. If it is, the initiated play of the Big Ride first round (process 68A) terminates and is replaced by a play of a Pan-9 first round as shown by process 60. After process 60, the method moves on, in accordance with the flow chart 50, to decision 82. On the other hand, if the player-bank's least significant digit is not a nine, decision 70 moves the method to process 68B where the Big Ride first round is completed.

This second Big Ride preferred embodiment evens the odds of winning between the player-bank and the other players. Replacing, in this case, the Big Ride first round with a Pan-9 first round enhances the chances of the other players and provides greater incentive for them to wager.

Following the Big Ride first round, the method illustrated in FIG. 3 has decision 64, which asks if the player-bank won the first round, i.e., he won more than he lost against other players—a net win. If the player-bank won the first round, he must play a second Pan-9 player-bank, after which the player-bank passes to the succeeding player as respectively indicated in process 62 and terminator 72.

In this second Pan-9 player-bank, the player-bank must wager an amount at least as great as his final balance in process 68, i.e., his first round wager plus his net win. This means that all or a portion of the final balance of process 68 may be matched by wagers of the other players in the second round. This gives them an opportunity to win back their wagers and also offers the player-bank an opportunity to increase his winnings further. In game idiom, the player-bank may be said to have taken "The Big Ride" if he wins both the first Big Ride round and the second Pan-9 round.

If the answer to decision 64 is negative, i.e., the player-bank lost more than he won—a net loss in process 68 (combined processes 68A, 68B), the player-bank moves to decision 74, which offers third and fourth wagering options respectively comprising playing a second Pan-9 player-bank (process 76) or passing the player-bank to the succeeding player (terminator 78). If the player-bank plays a second Pan-9 round, the player-bank is then passed in process 80. The same third and fourth wagering options are offered to the player-bank after process 60 as shown by decision 82, process 84 and terminators 86, 88.

The preferred method embodiment, described with reference to FIGS. 1 through 4, offers several wagering options to game players which may lead to the involvement of more players in each game round. In the first wagering option, the player-bank is involved (in determining winners and transferring wagers) only with those successive players, beginning with first action, whose combined wagers are less than or equal to the player-bank's wager. Against those players, the player-bank may win or lose only as much as his wager.

However, in the second wagering option (The Big Ride), the player-bank continues to be involved (in determining winners and transferring wagers) with successive players until a winner has been determined between the player-bank and each of the other players or his net loss equals his wager. Wins and losses of the player-bank are respectively added to and subtracted from his wager to form his balance. Against those involved players, the player-bank's net win may be as much as their combined wagers and his net loss only as much as his wager.

The Big Ride wagering process offers significant advantages. For example, more players are generally involved in each playing round. In addition, the size of the player-bank's wager in the second round following a first Big Ride round win is typically larger since the first round wager plus the net win of the first round must be wagered by the player-bank in the second round. These features of the Big Ride increase player excitement and enjoyment, and offer greater income to the cardroom since more action is involved.

In the Pan-9 wagering process, wagers are provided by each of the game players and amounts equal to matched portions of the player-bank's wager are transferred from losers to winners. In the Big Ride wagering process, wagers are provided by each of the game players and amounts equal to bets calculated as the lesser of the player-bank's balance and opposing players' wagers are transferred from losers to winners. Although the wagers and the amounts transferred in these processes can be money, they preferably are money substitutes such as tokens or chips, which can be redeemed for money.

In cardrooms where the game playing method embodiments may be practiced, it is customary for wagers, in the form of redeemable chips, to be physically placed in designated betting areas as shown on the game table 20 of FIG. 1. It is also customary to indicate in some manner which players have won and lost against the player-bank as the determination of winners progresses successively around the game table. For example, a player's chips may be left next to his upturned cards to indicate a win, while the chips may be placed over his downturned cards to indicate a loss. In case of a tie, the chips are typically returned to the player. After all winners have been determined, the chips are physically transferred from losers to winners.

To inform other players of his choice among wagering options, the player-bank may orient an emblem, such as the emblem 30 shown in FIGS. 2A and 2B, to display indicia associated with that option.

Cardroom rules often permit wagers from others who are not seated players. Such wagering players typically stand behind the seated players and place wagers on the outcome between seated players. For example, such a person might wager that the player in seat **22*h* of FIG. 1 will win against the player-bank. The wager may be placed in a separately marked portion of the betting area proximate to chair 22*h***. Such wagers are usually called "backline" wagers.

It is common to limit the number of backline players wagering on a particular seated player to two and order them in accordance with the time they placed their respective wagers. If two backline players were to wager in favor of the player in chair **22*h***, a winner is first determined between the player-bank and that seated player and an amount is transferred therebetween as dictated by the wagering options described above. This process is then repeated with the first backline player, after which it is repeated with the second backline player. Finally, the process moves on to the succeeding seated player. That is, when backline players are permitted and they participate in a round, they are inserted into the successive order of players for that particular round.

On the other hand, the wagers of non-seated players may, with approval of the seated player, be combined with his wager. In this case, they are often referred to as "Kum-Kum" wagers and the combined wager is generally treated as though it were a single wager against the player-bank. In addition, cardroom rules usually permit a backline player, but not a "Kum-Kum" player, to make decisions concerning the play of the seated player's hand during the round in which they are participating if the backline player's wager exceeds that of the seated player.

From the foregoing, it should now be recognized that a game playing method has been disclosed herein especially suited for increasing player interest and involvement by offering a plurality of wagering options. The preferred embodiments of the invention described herein are exemplary and numerous modifications and rearrangements can be readily envisioned to achieve an equivalent result, all of which are intended to be embraced within the scope of the appended claims.

What is claimed is:

1. A method of playing a wagering game by a plurality of game players arranged in successive order, the method comprising the steps of: specifying a first one of said players; specifying a second one of said players; defining a first wagering process having the steps of;

a) providing, from each of said game players, a wager;

b) initiating an unmatched portion equal to the first player's wager;

c) matching a portion of the first player's wager against the second player's wager wherein said portion equals the lesser of said unmatched portion and said second player's wager or equals either of them if they are identical;

d) determining a game winner or a tie between said first and second players;

e) transferring an amount equal to said portion from said second player to said first player if said first player is said winner and from said first player to said second player if said second player is said winner and transferring nothing if said tie is determined;

f) modifying, if a winner was determined, said unmatched portion by subtracting therefrom said portion; and g) repeating the combination of said matching, determining, transferring and modifying steps with a different one of said players, excluding said first player, replacing, in successive order, said second player in each repetition, until the first occurs of (1) said transferring step has been completed between said first player and all other players and (2) said unmatched portion equals zero;

defining a second wagering process having the steps of;

a) providing, from each of said game players, a wager;

b) initiating a balance equal to the first player's wager;

c) establishing a bet equal to the lesser of said balance and the second player's wager or equal to either of them if they are identical;

d) determining a game winner or a tie between said first and second players;

e) transferring an amount equal to said bet from said second player to said first player if said first player is said winner and from said first player to said second player if said second player is said winner and transferring nothing if said tie is determined;

f) modifying said balance by adding said bet to it if said first player is said winner and subtracting said bet from it if said second player is said winner; and g) repeating the combination of said establishing, determining, transferring and modifying steps with a different one of said players, excluding said first player, replacing, in successive order, said second player in each repetition, until the first occurs of (1) said transferring step has been completed between said first player and all other players and (2) said balance equals zero;

wherein said game winner between said first player and another of said players in said first and second wagering processes is determined by the steps of;

a) setting a numerical goal;

b) dealing each of said first player and said another player a plurality of symbols, each of said symbols representing a numerical value;

c) adding the numerical value of the symbols of each player to find, for that player, the least significant digit of the sum; and d) deeming the game winner to be the player whose least significant digit is closest to said goal without exceeding it and deeming a tie if the players have the same least significant digit;

offering first and second wagering options to said first player for selection therebetween wherein said first wagering option includes the step of executing said first wagering process on a first game round; and wherein said second wagering option includes the step of executing said second wagering process on a first game round; and implementing the selected one of said first and second wagering options.

2. The method of claim 1 wherein said second wagering option further includes the step of executing said first wagering process on the succeeding game round if, at the conclusion of said second wagering process, said modifying step causes said balance to exceed said first player's wager.

3. The method of claim 2 wherein said second wagering option further includes the step of requiring a first player's wager, in said succeeding game round, to be at least as large as said balance at the conclusion of said second wagering process.

4. The method of claim 2 wherein said second wagering option further includes, after said executing step, the step of passing said specification of first player to the succeeding player.

5. The method of claim 1 wherein said wager in said providing steps and said amount in said transferring steps each comprise money.

6. The method of claim 1 wherein said wager in said providing steps and said amount in said transferring steps each comprise a money substitute.

7. The method of claim 1 further including, after said implementing step, the steps of:

offering, if said first wagering option was selected or if said second wagering option was selected and said modifying step at the conclusion of said second wagering process causes said balance to be less than said first player's wager, third and fourth wagering options to said first player for selection therebetween;

wherein said third wagering option includes the step of executing said first wagering process on the succeeding game round;

and wherein said fourth wagering option includes the step of passing said specification of first player to the succeeding player; and implementing the selected one of said third and fourth wagering options.

8. The method of claim 7 wherein said third wagering option further includes, after said executing step, the step of passing said specification of first player to the succeeding player.

9. The method of claim 1 wherein said offering step is preceded by a step of offering to said first player the option of passing said specification of first player to the succeeding player.

10. The method of claim 1 wherein said offering step includes, in addition to said first and second wagering options, a fifth wagering option for said first player to select therebetween, said fifth wagering option including the steps of:

initiating said second wagering process on a first game round;

completing said second wagering process on a first game round if the player-bank's least significant digit in said initiating step is other than said numerical goal; and executing said first wagering process on a first game round if the player-bank's least significant digit in said initiating step equals said numerical goal.

11. The method of claim 1 wherein said numerical goal is nine and the numerical value of each of said symbols is selected from the group consisting of zero, one, two, three, four, five and six.

12. The method of claim 11 wherein said symbols comprise the face cards, the ace and number cards two through six of standard playing cards and the numerical value assigned the face cards is zero, the numerical value assigned the ace is one and the numerical value assigned each number card is its displayed number.

13. The method of claim 1 wherein said dealing step comprises the steps of:

providing to each of said first player and said another player three of said symbols; and offering each of said first player and said another player the option of a fourth of said symbols.

14. The method of claim 1 further comprising the steps of:

displaying proximate to said first player an emblem associated therewith to identify said first player to other of said players wherein said emblem bears first and second indicia respectively associated with said first and second wagering options; and orienting said emblem to display said first indicia if said first wagering option is selected and to display said second indicia if said second wagering option is selected.

15. A method of apportioning wagers between a plurality of game players arranged in successive order, the method comprising the steps of:

specifying a first one of said players;

specifying a second one of said players;

providing, from each of said game players, a wager;

initiating a balance equal to the first player's wager;

establishing a bet equal to the lesser of said balance and the second player's wager or equal to either of them if they are identical;

determining a game winner or a tie between said first and second players;

transferring an amount equal to said bet from said second player to said first player if said first player is said winner and from said first player to said second player if said second player is said winner and transferring nothing if said tie is determined;

modifying said balance by adding said bet to it if said first player is said winner and subtracting said bet from it if said second player is said winner; and repeating the combination of said establishing, determining, transferring and modifying steps with a different one of said players, excluding said first player, replacing, in successive order, said second player in each repetition, until the first occurs of (1) said transferring step has been completed between said first player and all other players and (2) said balance equals zero;

wherein said game winner between said first player and another of said players is determined by the steps of;

a) setting a numerical goal;

b) dealing each of said first player and said another player a plurality of symbols, each of said symbols representing a numerical value;

c) adding the numerical value of the symbols of each player to find, for that player, the least significant digit of the sum; and d) deeming the game winner to be the player whose least significant digit is closest to said goal without exceeding it and deeming a tie if the players have the same least significant digit.

16. The method of claim 15 wherein said wager in said providing step and said amount in said transferring step each comprise money.

17. The method of claim 15 wherein said wager in said providing step and said amount in said transferring step each comprise a money substitute.

18. The method of claim 15 wherein said numerical goal is nine and the numerical value of each of said symbols is selected from the group consisting of zero, one, two, three, four, five and six.

19. The method of claim 15 wherein said symbols comprise the face cards, the ace and number cards two through six of standard playing cards and the numerical value assigned the face cards is zero, the numerical value assigned the ace is one and the numerical value assigned each number card is its displayed number.

20. The method of claim 15 wherein said dealing step comprises the steps of:

providing to each of said first player and said another player three of said symbols; and offering each of said first player and said another player the option of a fourth of said symbols.

* * * * *